US012006644B2

(12) United States Patent
Bellinger et al.

(10) Patent No.: US 12,006,644 B2
(45) Date of Patent: Jun. 11, 2024

(54) ROBOTIC SYSTEMS AND METHODS FOR COLLECTING TRASH OUTDOORS

(71) Applicants: William Daniel Bellinger, Williamston, MI (US); Camden Henry Denk, Webberville, MI (US); Ethan Frederick Egger, Williamston, MI (US); Emmett Monroe Fountain, Williamston, MI (US); Owen Keith Gulick, Williamston, MI (US); Amanda Nicole Jaworsky, Williamston, MI (US); Katelyn Suzanne Kersten, Williamston, MI (US); Steven Michael Kersten, Williamston, MI (US); Gabriel Steven Lounsbury, Williamston, MI (US); Noah Riley Palmatier, Williamston, MI (US); Joseph Andrew Rasmus, Saranac, MI (US); Faith Mae Schafer, Williamston, MI (US); Jack Arthur Schafer, Williamston, MI (US); Allyson Christine Suandi, Okemos, MI (US); Trucy Thanh Truong-Phan, Okemos, MI (US)

(72) Inventors: William Daniel Bellinger, Williamston, MI (US); Camden Henry Denk, Webberville, MI (US); Ethan Frederick Egger, Williamston, MI (US); Emmett Monroe Fountain, Williamston, MI (US); Owen Keith Gulick, Williamston, MI (US); Amanda Nicole Jaworsky, Williamston, MI (US); Katelyn Suzanne Kersten, Williamston, MI (US); Steven Michael Kersten, Williamston, MI (US); Gabriel Steven Lounsbury, Williamston, MI (US); Noah Riley Palmatier, Williamston, MI (US); Joseph Andrew Rasmus, Saranac, MI (US); Faith Mae Schafer, Williamston, MI (US); Jack Arthur Schafer, Williamston, MI (US); Allyson Christine Suandi, Okemos, MI (US); Trucy Thanh Truong-Phan, Okemos, MI (US)

( * ) Notice: Subject to any disclaimer, the term of this patent is extended or adjusted under 35 U.S.C. 154(b) by 845 days.

(21) Appl. No.: 17/037,926

(22) Filed: Sep. 30, 2020

(65) Prior Publication Data

US 2022/0097236 A1 Mar. 31, 2022

(51) Int. Cl.
*E01H 1/08* (2006.01)
*A47L 9/28* (2006.01)

(52) U.S. Cl.
CPC ..... *E01H 1/0836* (2013.01); *A47L 9/2842* (2013.01); *A47L 9/2852* (2013.01); *A47L 2201/04* (2013.01); *A47L 2201/06* (2013.01)

(58) Field of Classification Search
CPC .... E01H 1/0836; A47L 9/2842; A47L 9/2852; A47L 2201/04; A47L 2201/06
(Continued)

(56) References Cited

U.S. PATENT DOCUMENTS 3,621,919 A * 11/1971 Olson ..... E01H 12/00 171/120
5,199,996 A * 4/1993 Jonas ..... A47L 11/4061 134/21

(Continued)

FOREIGN PATENT DOCUMENTS

CN 205421127 U * 8/2016 ..... E01H 1/08
CN 115323973 A * 11/2022 ..... E01H 1/0836
WO WO-2014111898 A2 * 7/2014 ..... A01B 69/008

OTHER PUBLICATIONS

Website Printout: https://yellrobot.com/beach-cleaning-robots-thailand/, published Sep. 27, 2018; pages of website downloaded on Jan. 6, 2021; 5 pages.

(Continued)

*Primary Examiner* — Bryan R Muller
(74) *Attorney, Agent, or Firm* — Howard & Howard Attorneys PLLC

(57) ABSTRACT

Robotic systems and methods for collecting trash are provided. The robotic system includes a vehicle, a camera, a trash collection unit, an actuator, and a controller. The vehicle includes a drive. The camera moves with the vehicle to capture images of the trash while the vehicle moves along (Continued)

ground. The trash collection unit is carried by the vehicle to collect the trash. The trash collection unit includes a vacuum pump and a collection conduit. The actuator is operatively coupled to the collection conduit to adjust a position of the collection conduit relative to the vehicle to position the collection conduit adjacent to the trash to collect the trash. The controller is coupled to the drive, the camera, the trash collection unit, and the actuator to coordinate movement of the vehicle, positioning of the collection conduit, and operation of the vacuum pump to collect the trash.

8 Claims, 8 Drawing Sheets

(58) Field of Classification Search
USPC ..... 15/340.1–340.4
See application file for complete search history.

(56) References Cited

U.S. PATENT DOCUMENTS

| | | | | |
|---|---|---|---|---|
| 5,309,592 | A * | 5/1994 | Hiratsuka | A47L 11/4011 15/49.1 |
| 5,317,783 | A * | 6/1994 | Williamson | A01G 20/47 15/340.1 |
| 2011/0004342 | A1* | 1/2011 | Knopow | A47L 5/28 701/25 |
| 2012/0260944 | A1* | 10/2012 | Martins, Jr. | A47L 9/2826 15/340.1 |

OTHER PUBLICATIONS

Website Printout: http://www.en.psu.ac.th/international/international-news/701-first-thai-beach-cleaning-robot-developed-by-pttep-and-psu/; pages of website downloaded on Jan. 6, 2021; 8 pages.
Website Printout: https://en.beach-trotters.com/products/kangur-12; pages of website downloaded on Jan. 6, 2021; 5 pages.
YouTube Video entitled "Maquina limpieza playas", https://www.youtube.com/watch?v=0slvB5hZCJw, published Nov. 4, 2010.
Website Printout: https://makezine.com/2016/05/20/learnings-robot-shoreline/, published May 20, 2016; pages of website downloaded on Jan. 6, 2021; 18 pages.
Website Printout: https://www.beach-tech.com/ita/en/models/hotel-and-lake-beaches/beachtech-sweepy.html?keyword=&device=c&network=g&gclid=EAlalQobChMl4vPioYeF7glVj4bACh08EwowEAAYASAAEgL8byDBwE; pages of website downloaded on Jan. 6, 2021; 11 pages.
Website Printout: https://www.dronyx.com/solarino-beach-cleaner/; pages of website downloaded on Jan. 6, 2021; 13 pages.
YouTube Video entitled "Technical Video for Solarino Beach Cleaner Robot", https://www.youtube.com/watch?v=17FHbc67iQY, published Apr. 30, 2015.
Website Printout: https://ottawa.citynews.ca/local-news/high-hopes-for-ottawa-beach-cleaning-robot-965558, published Jun. 25, 2018; pages of website downloaded on Jan. 6, 2021; 3 pages.
YouTube Video entitled "Beach Cleaning—Beach Cleaner—Compact Tractor Beach Cleaning Machine", https://www.youtube.com/watch?v=MA-g5ezAcRk, published May 30, 2020.
YouTube Video entitled "RF Controlled Beach Cleaner Robotic Vehicle", https://www.youtube.com/watch?v=tiD65VBrrRM, published Jun. 29, 2018.
YouTube Video entitled "Sand Cleaning Robot", https://www.youtube.com/watch?v=9sbQN2VB9DI, published Jun. 6, 2013.
Schmoeller da Roza, Felippe; Ghizoni da Silva, Vinicius; Pereira, Patrick Jose: and Bertol, Douglas Wildgrube. Modular Robot Used as a Beach Cleaner, I Will Engineer, Chilean Engineering Journal, Mar. 7, 2016, pp. 643-653, vol. 24. No. 4. Department of Automation and Systems, Federal University of Santa Catarina, Brazil.
Al Enezi Nouf F.: Al Ajmi, Omar K.; Al Sharhan, Sarah A.: and Khudada, Sarah T., Autonomous Beach Cleaner, Department of Electrical and Computer Engineering, ELEG/CPEG 480-Capstone Design Project II, May 15, 2019, 166 pages, American University of Kuwait.
Dromedar Beach Cleaner. Unicorn Beach Cleaners, 6 pages. Beach Trotters S.L., C. Joan Güell 19, P.O. Box: 207, 43830 Torredembarra, Tarragona, Spain.

* cited by examiner $v_{robot}$ = robot velocity (constant for simple case)

$v_{head}$ = target vacuum head velocity (variable for simple case)

$x_{image}$, $y_{image}$ = trash coordinates from image $x_1$ = current x coordinate for vacuum head $x_{target} = x_{image}$ = target x coordinate for vacuum head $y_{target} = y_1$ = known, fixed y coordinate for vacuum head $$\Delta x = x_1 - x_{target}$$

$$\Delta y = y_{target} - y_{image}$$

$$t_{suction} = (\Delta y / v_{robot}) + t_1$$

$$v_{head} = \Delta x / (t_{suction} - t_1)$$

FIG. 7

ROBOTIC SYSTEMS AND METHODS FOR COLLECTING TRASH OUTDOORS

TECHNICAL FIELD

The present disclosure relates to systems and methods for collecting trash outdoors, such as at beaches and parks.

BACKGROUND

Collecting trash outdoors, such as at beaches and parks, can be challenging. Often, trash is collected manually, but typically includes smaller pieces that can be difficult to spot and/or collect by personnel assigned to such tasks. In some cases, larger machinery may be pulled behind a vehicle (e.g., a tractor) or pushed manually to collect trash, but still requires personnel to continuously operate the machinery. Such machinery also tends to be large and can require significant energy to operate. Accordingly, there is a need in the art for trash collection systems and methods that address one or more of these challenges.

SUMMARY

A robotic system is provided for collecting trash. The robotic system comprises a vehicle, a camera, a trash collection unit, an actuator, and a controller. The vehicle includes a frame and a drive. The camera is coupled to the vehicle to move with the vehicle to capture images of the trash while the vehicle moves along ground. The trash collection unit is carried by the vehicle to collect the trash. The trash collection unit includes a vacuum pump and a collection conduit. The actuator is operatively coupled to the collection conduit to adjust a position of the collection conduit relative to the vehicle to position the collection conduit adjacent to the trash to collect the trash. The controller is coupled to the drive, the camera, the trash collection unit, and the actuator to coordinate movement of the vehicle, positioning of the collection conduit, and operation of the vacuum pump to collect the trash.

A method is provided for robotically collecting trash with a robotic system including a vehicle, a camera, a trash collection unit, an actuator, and a controller. The method comprises: moving the vehicle along ground; capturing images of the trash while the vehicle moves along the ground; adjusting, with the actuator, a position of a collection conduit of the trash collection unit relative to the vehicle to position the collection conduit adjacent to the trash to collect the trash; and coordinating, with the controller, movement of the vehicle, positioning of the collection conduit, and operation of the vacuum pump to collect the trash.

BRIEF DESCRIPTION OF THE DRAWINGS

Advantages of the present disclosure will be readily appreciated as the same becomes better understood by reference to the following detailed description when considered in connection with the accompanying drawings wherein:

FIG. 7 is an example set of calculations that can be used to locate the trash and operate the robotic system to reach the trash.

DETAILED DESCRIPTION

Figure 1:
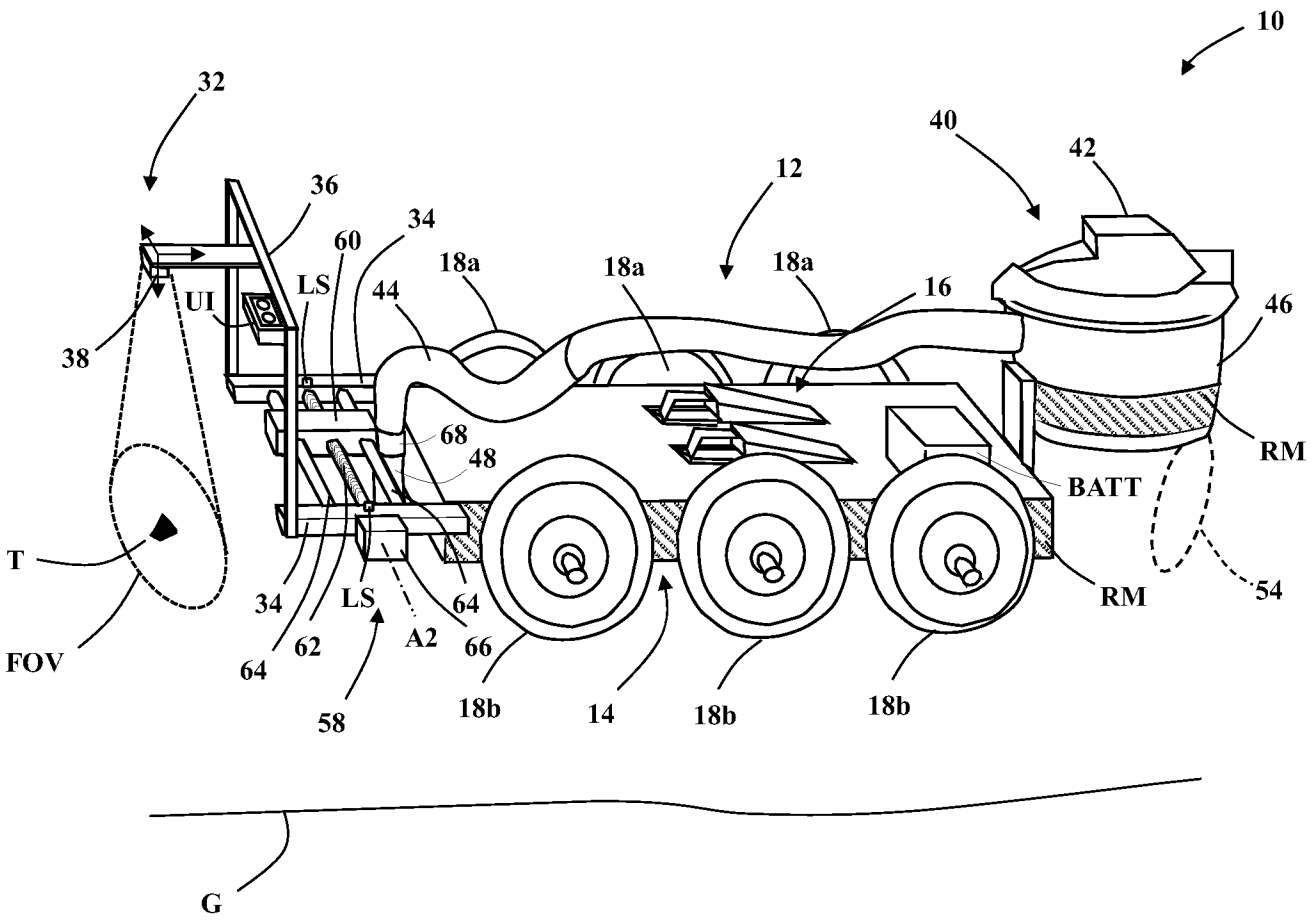
FIG. 1 is a perspective view of a robotic system for collecting trash.

Referring to FIG. 1, a robotic system 10 is shown for collecting trash T. The robotic system 10 is configured to assist with removing the trash T from outdoor locations, such as beaches, parks, and the like. It is often challenging to collect and remove trash T from outdoors, particularly when the trash T is located on ground G that includes sand, dirt, grass, other ground covering, etc. In some versions, the robotic system 10 is configured to remove the trash T from the ground G while largely keeping the ground G intact. The trash T may include various types of trash/refuse/debris, including, for example, plastic/foam pieces, metal pieces, wood pieces, combinations thereof, and may include, in some cases, natural plant materials.

Referring to FIG. 1, the robotic system 10 includes a vehicle 12 having a frame 14. A drive 16 moves the vehicle 12 along the ground G. The vehicle 12 includes a first plurality of wheels 18*a* rotatably coupled to the frame 14 and a second plurality of wheels 18*b* rotatably coupled to the frame 14. The first plurality of wheels 18*a* are located at a first side (right side) of the vehicle 12 and the second plurality of wheels 18*b* are located at a second side (left side) of the vehicle 12. In the version shown, there are at least three wheels 18*a* on the first side of the vehicle 12 and at least three wheels 18*b* on the second side of the vehicle. This arrangement can help distribute loads on the vehicle 12 and improve traction with the ground G. In some versions, there may be two wheels on each side of the vehicle 12, or four or more wheels on each side. The wheels 18*a*, 18*b* may include balloon tires to further assist with traction, such as when the ground includes sand. The vehicle 12 may alternatively, or additionally, include one or more treads. Various types of driven, transport elements (e.g., wheels, treads, etc.) are contemplated.

Reflective material RM may be attached to the vehicle 12 to assist with spotting the vehicle 12 during low light conditions. The reflective material RM may include one or more reflective elements, such as reflective tapes, reflective coatings, or reflective paint.

Figure 2:
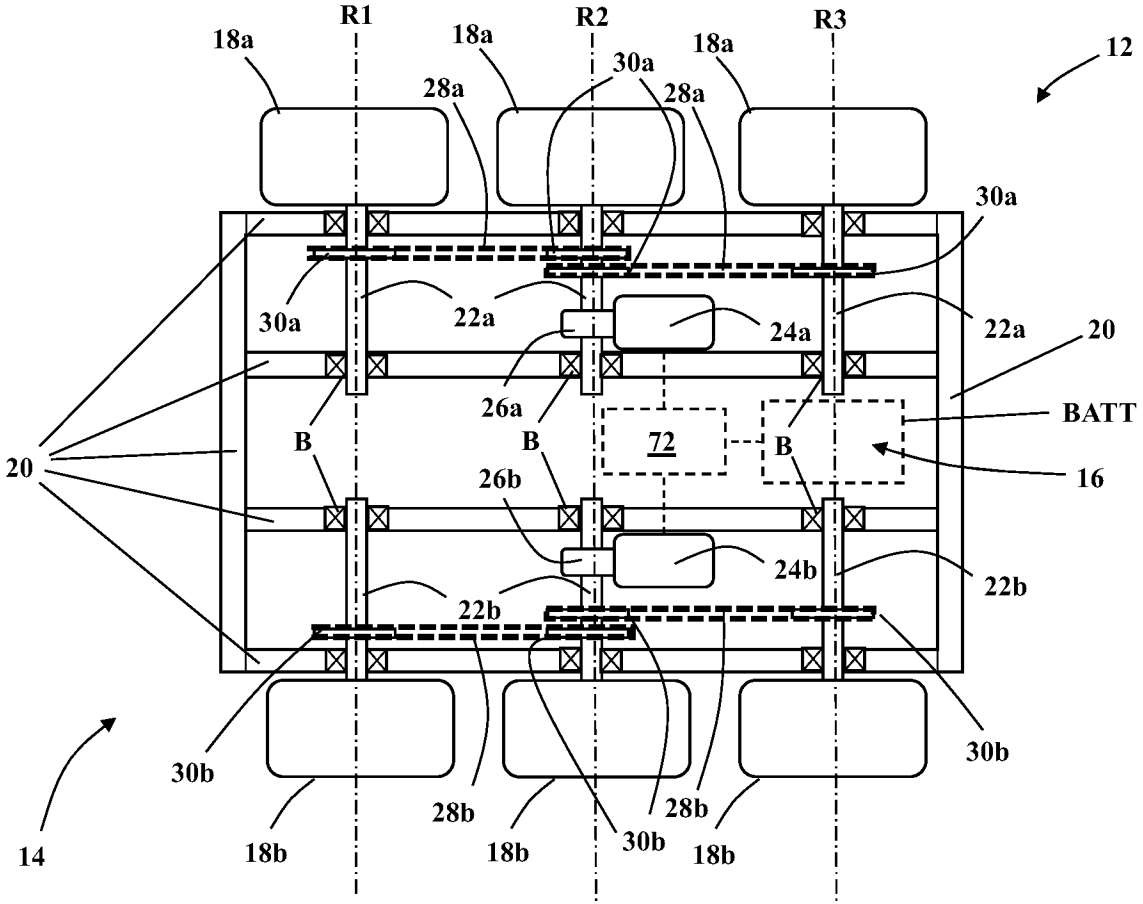
FIG. 2 is a top schematic view of a vehicle of the robotic system including a frame and a drive.

As shown in FIG. 2, the frame 14 includes structural supports 20 that may be formed from metal tubing, plastic, combinations thereof, and the like. In the version shown, the frame 14 is formed of a plurality of supports 20 formed from metal tubing that are welded together to form a rigid body. The frame 14 provides a chassis to which other components of the robotic system 10 may be mounted as described further below. Other forms for the frame 14 are also contemplated.

Axles 22*a*, 22*b* are rotatably supported by the supports 20 via bearings, bushings, combinations thereof, and the like. In some versions, pillow blocks B having internal bearings may be mounted to one or more of the supports 20 to rotatably support the axles 22*a*, 22*b* so that the axles 22*a*, 22*b* are able to rotate about a plurality of drive axes R1, R2, R3 relative to the frame 14. As shown, there is a first set of axes 22*a* to which the wheels 18*a* on the first side of the vehicle 12 are mounted and a second set of axes 22*b* to which the wheels 18*b* on the second side of the vehicle 12 are mounted. The wheels 18*a* on the first side are independently drivable from the wheels 18*b* on the second side as described further below. In some versions, axles connect the wheels on both sides of the vehicle.

The drive 16 includes a first drive motor 24*a* operatively coupled to the first plurality of wheels 18*a* to rotate the first plurality of wheels 18*a* about the respective axes R1, R2, R3 via the first set of axles 22*a*. The drive 16 also includes a second drive motor 24*b* operatively coupled to the second plurality of wheels 18*b* to rotate the second plurality of wheels 18*b* about the respective axes R1, R2, R3 via the second set of axles 22B. The drive motors 24*a*, 24*b* are independently operable so that the first plurality of wheels 18*a* can be rotated independently of the second plurality of wheels 18*b*. This can be useful for turning maneuvers in which the first drive motor 24*a* drives the first plurality of wheels 18*a* in a forward direction, while the second drive motor 24*b* drives the second plurality of wheels 18*b* in a reverse direction, causing tight rotation of the vehicle 12 (e.g. zero turn).

The drive 16 further includes a first transmission 26*a* operatively interconnecting the first drive motor 24*a* to the first set of axles 22*a* and a second transmission 26*b* operatively interconnecting the second drive motor 24*b* to the second set of axles 22*b*. The transmissions 26*a*, 26*b* may include any suitable gear train to convert rotations of the drive motors 24*a*, 24*b* into rotations of the drive axles 22*a*, 22*b*. In the version shown, the first drive motor 24*a* drives a single one of the axles 22*a* through transmission 26*a*, and the remaining drive axles 22*a* of the first set of drive axles 22*a* are driven through drive chains 28*a* connecting to the remaining drive axles 22*a* via sprockets 30*a* fixed to the drive axles 22*a*. Likewise, the second drive motor 24*b* drives a single one of the axles 22*b* through transmission 26*b*, and the remaining drive axles 22*b* of the second set of drive axles 22*b* are driven through drive chains 28*b* connecting to the remaining drive axles 22*b* via sprockets 30*b* fixed to the drive axles 22*b*. Ultimately, the drive 16 is operable to maneuver the vehicle 12 along the ground G in response to command signals so that the robotic system 10 moves into a position to collect the trash T found along the ground G.

Referring back to FIG. 1, a machine vision unit 32 is fixed to the frame 14 of the vehicle 12. In the version shown, additional supports 34, such as metal tubing, or other forms of support structures, form part of the frame 14. The frame 14 further includes a mounting bracket 36 fixed to and extending from the supports 34. The mounting bracket 36 includes a pair of arms and a cross bar interconnecting the arms. Any form of mounting bracket 36 may be employed to mount the machine vision unit 32 to the frame 14. The machine vision unit 32 is attached to the mounting bracket 36 to hold the machine vision unit 32 in a fixed relationship to the frame 14. The machine vision unit 32 includes one or more cameras 38 that are coupled to the vehicle 12 to move with the vehicle 12 to capture images of the trash T while the vehicle 12 moves along the ground G. One or more fixed and/or liquid lenses may be used with the camera 38 to capture the images. The camera 38 may be a standard USB camera capable of capturing still images in RGB format. The camera 38 may include one or more digital image sensors, such as CCD or CMOS sensors. In the version shown, a single camera 38 is mounted to the vehicle 12 and aimed so that its field of view FOV is located forward of the vehicle 12 so that the camera 38 is able to capture images of the ground G without any obstructions from other components of the robotic system 10. Any suitable form of machine vision unit and associated cameras, lenses, etc. may be employed to capture images of trash T located on the ground G.

Figure 3:
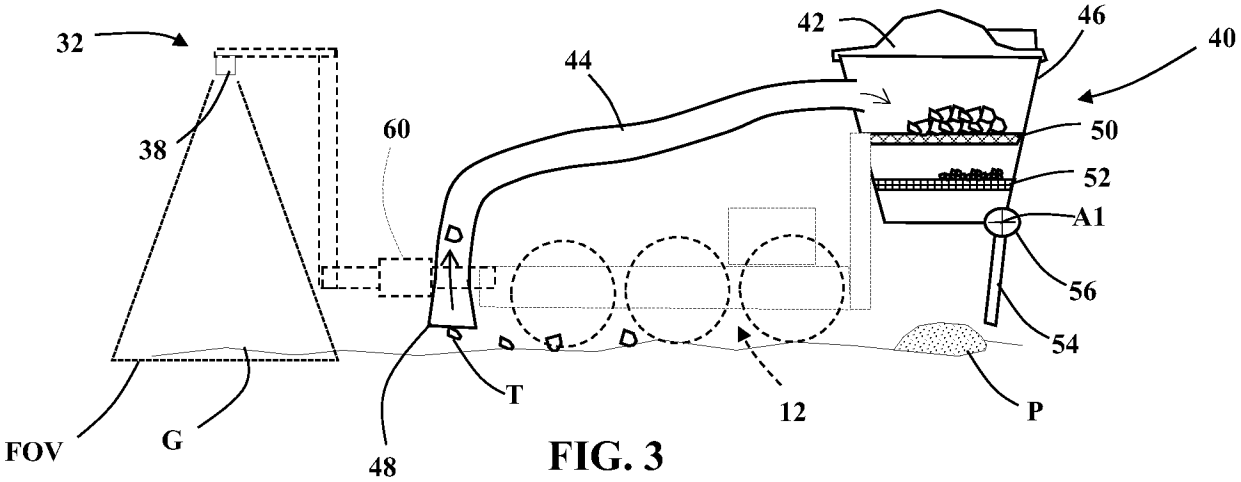
FIG. 3 is a side elevational view of the robotic system illustrating the trash collection unit collecting trash along ground.

Referring to FIGS. 1 and 3, a trash collection unit 40 is carried by the vehicle 12 to collect the trash T. The trash collection unit 40 includes a vacuum pump/motor 42, a collection conduit 44, and a trash canister 46 to hold the trash T. The vacuum pump/motor 42 and the collection conduit 44 may be similar to those utilized on conventional wet/dry shop vacuums. In the version shown, the collection conduit 44 includes a vacuum tube that extends from a location adjacent to a front of the vehicle 12 to the trash canister 46. The vacuum tube is coupled to the trash canister 46 and opens into an internal chamber of the trash canister 46 (see FIG. 3). The vacuum tube may include one or more tube sections connected together and a vacuum head 48 at its distal end. The vacuum pump/motor 42 may be integrated into a lid of the trash canister 46 to create suction in the vacuum tube and draw the trash T into the vacuum tube and through the vacuum tube to the trash canister 46. Like the frame 14, reflective material RM (see FIG. 1) may be attached to the trash canister 46 and/or other components of the trash collection unit 40.

As shown in FIG. 3, the trash canister 46 includes one or more material separation screens 50, 52 to retain the trash T in the trash canister 46 and a movable bottom 54 to release materials sized to pass through the one or more screens 50, 52. In the version shown, there are two material separation screens 50, 52, but there may be more or fewer screens. The first screen 50 is sized with openings of a first dimension (e.g., length, width, diameter) and the second screen 52 is sized with openings of a second dimension smaller than the first dimension so that the first screen 50 allows more particles to pass through as compared to the second screen 52. For instance, the first screen 50 may be formed of metal, plastic, combinations thereof, etc. with rectangular openings having a length by width of 1 inch by 1 inch and the second screen 50 may be formed of metal, plastic, combinations thereof, etc. with rectangular openings having a length by width of 0.5 inches by 0.5 inches. Other values for the screen sizes are also contemplated. Since the trash collection unit 40 operates outdoors and collects trash T that is present on the ground G that may include sand and dirt, there is a likelihood that during trash collection, sand and dirt will also be collected within the trash canister 46. Accordingly, the screens 50, 52 allow particles of a certain size, such as sand and dirt particles, to pass through the screens 50, 52 and collect on the movable bottom 54 of the trash canister 46.

The trash canister 46 is shown mounted to a bracket of the frame 14 to be thereby fixed relative to the frame 14. The trash canister 46 may be mounted via fasteners, welding, clamps, straps, or the like. In some versions the trash canister 46 is disposed on an upper surface of the frame 14, such as on a bed of the frame 14 near the battery BATT or located more forward on the frame 14, e.g., near a front of the vehicle 12. The trash canister 46 may be positioned at any suitable location to collect the trash T. In some versions, the trash canister 46 may be attached to a separate cart pulled by the vehicle 12.

Periodically, or once a certain volume or weight of such particles are collected in the trash canister 46 on the movable bottom 54, the movable bottom 54 is moved (e.g., pivoted) and a bottom of the trash canister 46 is opened to allow the collected particles (e.g., sand and dirt) to be deposited back on the ground G (see the pile P illustrated in FIG. 3). The trash canister 46 includes a dump motor 56 operatively coupled to the movable bottom 54 to selectively move the movable bottom 54 to open and close the bottom of the trash canister 46. The dump motor 56 may be a BLDC motor, stepper motor, servo motor, or other suitable motor that is mounted to the trash canister 46 and has a motor shaft that is operatively coupled to the movable bottom 54 (e.g., direct connection or indirect connection) to open and close the bottom of the trash canister 46 by pivoting the movable bottom 54 about a pivot axis A1. The movable bottom 54 may be connected to a wall of the trash canister 46 by a hinge with one or more pivot pins, shafts, etc., or may be connected by any suitable pivot structure.

Figure 4:
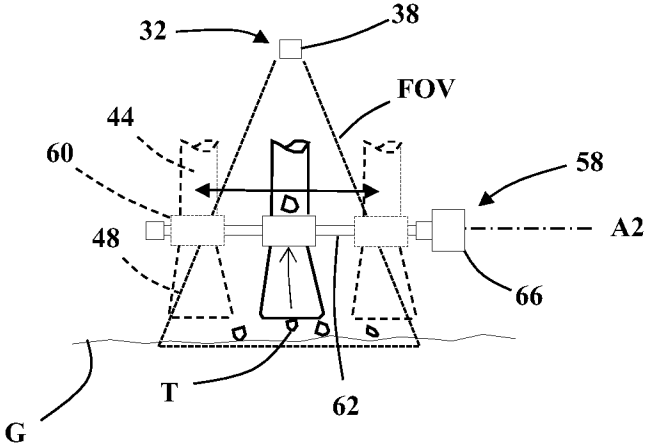
FIG. 4 is a front elevational view of the robotic system illustrating the trash collection unit collecting trash along the ground.

Referring to FIGS. 1 and 4, an actuator 58 is operatively coupled to the collection conduit 44 to adjust a position of the vacuum head 48 of the collection conduit 44 relative to the vehicle 12. The actuator 58 operates, along with the drive 16, to position the vacuum head 48 of the collection conduit 44 adjacent to the trash T to collect the trash T. The actuator 58 includes a carriage 60 and a drive screw 62 rotatable about a drive axis A2. The drive screw 62 is threadably coupled to the carriage 60. The actuator 58 also includes a pair of linear slides/rails 64 along which the carriage 60 slides in a lateral direction. A rail motor 66 is directly connected to the drive screw 62 to rotate the drive screw 62 about the drive axis A2. The linear slides/rails 64 may be smooth-surfaced tubes that are fixed to and extend between the supports 34. The rail motor 66 may be a BLDC motor, stepper motor, servo motor, or other suitable motor. The carriage 60 includes a carriage body having a threaded throughbore that threadably receives the drive screw 62 and smooth throughbores that receive the slides/rails 64 so that as the drive screw 62 rotates about the drive axis A2, the carriage 60 slides laterally (in the direction of the drive axis A2) along the linear slides/rails 64. In some versions, the actuator 58 includes a linear belt drive to move the carriage 60 in the manner described. Other forms of the actuator 58 are also contemplated.

A bracket, strap, clamp, fastener, or other suitable mounting device 68 mounts the vacuum head 48 of the collection conduit 44 to the carriage 60 to move in the lateral direction with the carriage 60 upon actuation of the drive screw 62. The mounting device 68 effectively secures the vacuum head 48 to the carriage 60 so that the actuator 58 is capable of accurately adjusting a position of the vacuum head 48 to ultimately position the vacuum head 48 adjacent each piece of trash T identified in the images of the camera 38 so that the trash T can thereafter be collected by the trash collection unit 40 and captured in the trash canister 46 via activation of the vacuum pump 42.

Operation of the actuator 58 and operation of the drive 16 are coordinated to cause suitable movement of the vacuum head 48 in longitudinal and lateral directions so that the vacuum head 48 is positioned adjacent to each piece of trash T. In the version shown, the drive 16 is largely responsible for driving the vehicle 12 in a longitudinal direction perpendicular to the lateral direction (e.g., perpendicular to axis A2) to move the vacuum head 48 in the longitudinal direction and the actuator 58 is responsible for moving the vacuum head 48 in the lateral direction (e.g., parallel to axis A2) so that the vacuum head 48 is moved in two degrees of freedom (x, y) to reach the trash T.

The vacuum head 48 may be mounted to the carriage 60 so that the vacuum head 48 is spaced a suitable fixed distance from the ground G to be able to collect the trash T. In some cases, the vacuum head 48 may be spaced 1, 2, or 3 inches from the ground G. Other spacings for the vacuum head 48 are also contemplated. In some versions, the vacuum head 48 may also be adjustable in its spacing from the ground G, i.e., in a third degree of freedom (z) via a separate motor (not shown). In some versions, the vacuum head 48 may be adjustable in more than three degrees of freedom.

Figure 5:
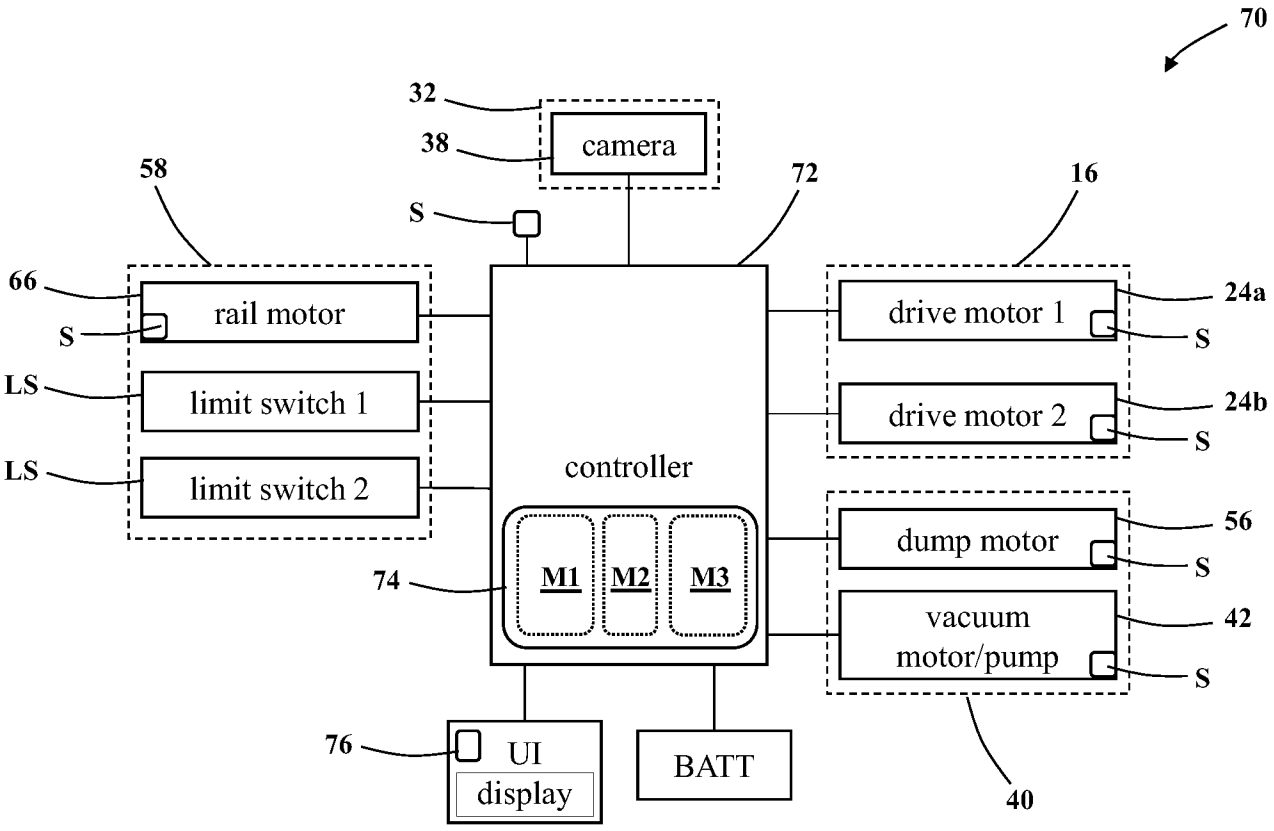
FIG. 5 is a schematic illustration of a control system.

Referring to FIG. 5, a control system 70 is shown to control operation of the robotic system 10. The control system 70 includes a controller 72 coupled to and in communication with the drive 16, the machine vision unit 32, the trash collection unit 40, and the actuator 58. The controller 72 is coupled to these components to coordinate movement of the vehicle 12, positioning of the vacuum head 48 of the collection conduit 44, and operation of the vacuum pump/motor 42. In particular, the controller 72 is coupled to and in communication with the drive motors 24*a*, 24*b*, the camera 38 (and/or any associated electronically controlled lenses), the vacuum pump/motor 42, the dump motor 56, and the rail motor 66. In some versions, the controller 72 is a Raspberry Pi controller available from the Raspberry Pi Foundation, United Kingdom. In some versions, the controller 72 includes a Jetson AGX Xavier controller from NVIDIA of Santa Clara, California. Additionally, or alternatively, the controller 72 may comprise one or more microprocessors, microcontrollers, field programmable gate arrays, systems on a chip, discrete circuitry, and/or other suitable hardware, software, or firmware that is capable of carrying out the algorithms/functions described herein. The controller 72 is configured to transmit and/or receive input/output signals to/from the various components shown in FIG. 5. The controller 72 may communicate with these components via wired or wireless connections to control the various components shown, to control other components not represented in FIG. 5, and/or to otherwise carry out the functions described herein.

In some versions, the controller 72 is mounted to the frame 14 of the vehicle 12 but can be mounted at any suitable location of the robotic system 10. Memory 74 may be any memory suitable for storage of data and computer-readable instructions, such as the instructions provided by programs used to carry out the algorithms/functions described herein. For example, the memory 74 may be a local memory, an external memory, or a cloud-based memory embodied as random-access memory (RAM), non-volatile RAM (NVRAM), flash memory, or any other suitable form of memory. Power to the various components of the robotic system 10 may be provided by a battery power supply and/or an external power source, such as by one or more batteries BATT located on the vehicle 12, solar power, wind power, and the like. Additionally, or alternatively, a gas/diesel-powered generator may be used to generate power for the various components.

In some versions, the controller 72 includes an internal clock to keep track of time. In some versions, the internal clock is a microcontroller clock. The microcontroller clock may include a crystal resonator, a ceramic resonator, a resistor capacitor (RC), oscillator, or a silicon oscillator. Examples of other internal clocks other than those disclosed herein are fully contemplated. The internal clock may be implemented in hardware, software, or both. In some embodiments, the memory 74, microprocessors, and microcontroller clock cooperate to send signals to and operate the various components shown in FIG. 5 to meet predetermined timing parameters. These predetermined timing parameters are discussed in more detail below.

A user interface UI with display is coupled to the controller 72. The user interface UI has one or more user input devices 76 (also referred to as controls), which transmit corresponding input signals to the controller 72, and the controller 72 may control certain functions of the robotic system 10 based on the input signals. The user input devices 76 may include any device capable of being actuated by the user and may be provided on a control panel, touchscreen, or the like. The user input devices 76 may be configured to be actuated in a variety of different ways, including but not limited to, mechanical actuation (hand, foot, finger, etc.), hands-free actuation (voice, foot, etc.), and the like. The user input devices 76 may include buttons, a gesture sensing device for monitoring motion of hands, feet, or other body parts of the user (such as through the camera 38), a microphone for receiving voice activation commands, a foot pedal, and sensors (e.g., infrared sensor such as a light bar or light beam to sense a user's body part, ultrasonic sensors, capacitive sensors, etc.). Additionally, the buttons/pedals can be physical buttons/pedals, such as pushbuttons, or virtually implemented buttons/pedals such as through optical projection or on a touchscreen. The buttons/pedals may also be mechanically connected or drive-by-wire type buttons/pedals where a user applied force actuates a sensor, such as a switch or potentiometer. It should be appreciated that any combination of user input devices may also be utilized. The user interface UI can also be implemented on a remote-control pendant with associated controls to control operation of the robotic system 10, and may be implemented, for example, on a portable electronic device, such as an iPhone®, iPad®, or the like.

The controller 72 is also coupled to one or more sensors S associated with the components shown in FIG. 5 to monitor certain parameters and control operation of these components. Some sensors S may, for example, measure rotational/angular position, velocity, acceleration, and the like. Some sensors S may measure current, voltage, torque, and the like. The sensors S may be integrated with their associated components or may be separate sensors. The sensors S may be in wired and/or wireless communication with the controller 72. The sensors S may include one or more position sensors, such as encoders, hall-effect sensors, limit switches, potentiometers, etc., current sensors, speed sensors, pressure sensors, voltage meters, current meters, and/or any other suitable sensors.

In some versions, the drive motors 24*a*, 24*b* include position sensors S in the form of hall-effect sensors or encoders for determining a rotational position and angular velocity of their associated drive shafts so that the controller 72 is able to determine position, velocity, and acceleration of the vehicle 12 by correlating the drive shaft positions, velocities, and/or accelerations to vehicle position, velocity, and/or acceleration in one or more degrees of freedom. The hall-effect sensors/encoders may be integrated into the drive motors 24*a*, 24*b*, or may be separate. Additionally, or alternatively, position sensors may be responsive to rotations of the axles 22*a*, 22*b*. The dump motor 56 may have a position sensor to determine whether the movable bottom 54 is in the open or closed state. In some cases, the position sensor for the dump motor 56 is in the form of one or more limit switches attached to the trash canister 46 or elsewhere that are associated with the open and/or closed states and that change signal states when the movable bottom 54 moves to/from the open/closed states. The vacuum pump/motor 42 may also include a pressure sensor that indicates whether a vacuum of suitable pressure is being generated in the trash canister 46 to draw in the trash T. The rail motor 66 may also have a position sensor to determine a position of the carriage 60 as described further below and/or may use one or more limit switches LS to calibrate the position of the carriage 60.

The control system 70 processes instructions from one or more computer programs, such as programs created in one or more programming languages (e.g., Python, C++, etc.) with third-party libraries including, for example, opencv, scikit-learn, scikit-image, and numpy. Such programs, or subroutines of such programs may form part of one or more program modules executed by the controller 72. Such modules may include, for example, an identification module M1 to identify trash T in the images captured by the camera 38, a behavior module M2 to determine how the vacuum head 48 needs to move to reach the trash T, and a control module M3 to execute necessary movements of the vacuum head 48 via the drive motors 24*a*, 24*b* and via the rail motor 66 and to execute operation of the vacuum pump/motor 42 to collect the trash T. The behavior module M2 receives, as input, data from the identification module M2 regarding locations of trash T. Based on this input data, the behavior module M2 determines desired movement of the vacuum head 48 and timing for activating suction, and outputs data regarding desired movements and timing to the control module M3. The control module M3 can then command appropriate movements from the drive motors 24*a*, 24*b* and rail motor 66 and command appropriate operation of the vacuum pump/motor 42.

Figure 6:
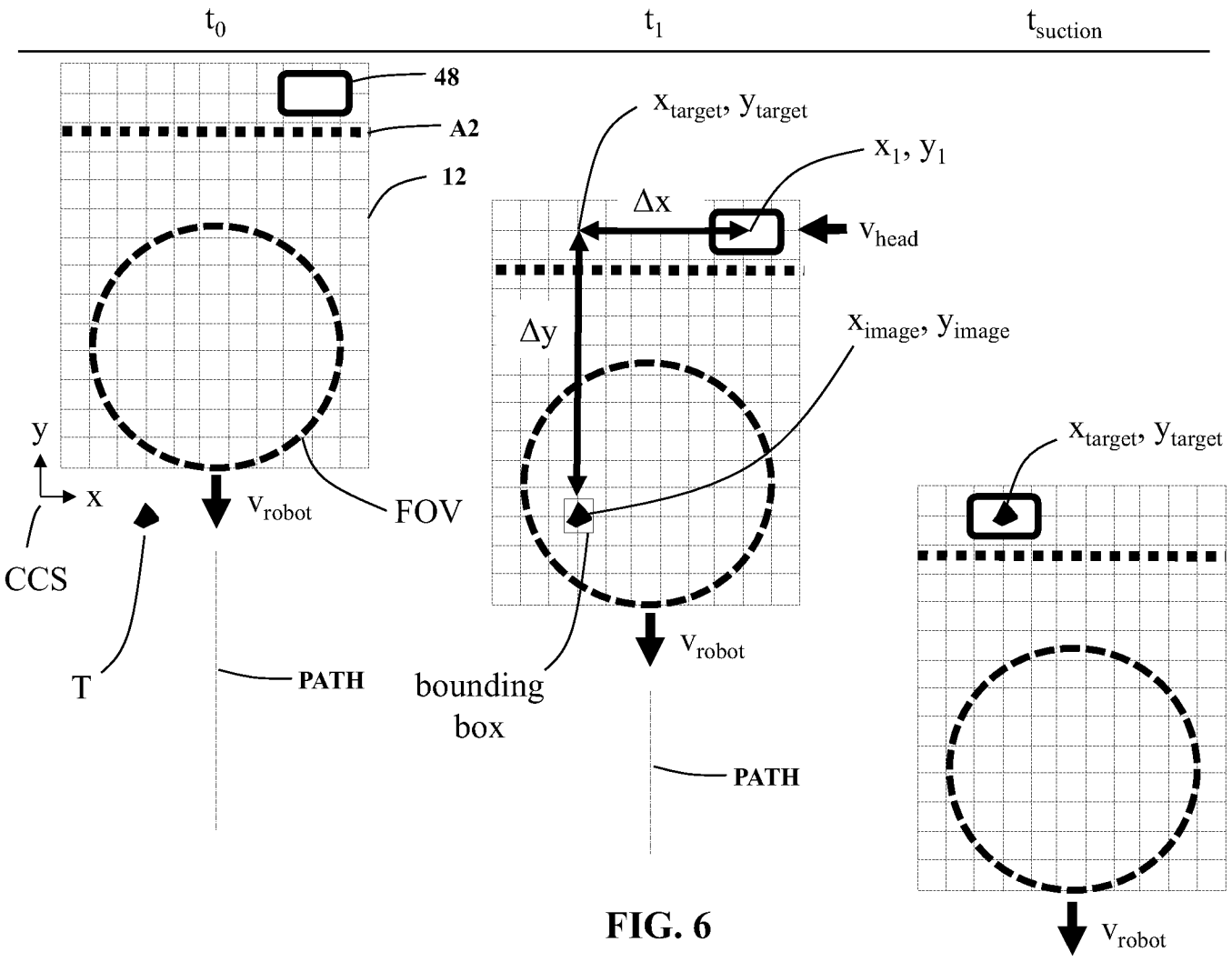
FIG. 6 is an illustration showing how a two-dimensional coordinate system is used to identify a location of trash for collection and how the vehicle is moved to reach the location of the trash.

FIG. 6 illustrates operation of the robotic system 10 to collect trash T starting at an initial time ($t_0$) at which the trash T is outside the field of view FOV of the camera 38, continuing to a first time ($t_1$) at which the trash T is within the field of view FOV of the camera 38 and identified in one of the images captured by the camera 38, and ending at a time ($t_{suction}$) that the vacuum pump/motor 42 is operated by the controller 72 to collect the trash T.

In the example illustrated, the control system 70 initially operates the drive 16 so that the vehicle 12 moves at a constant velocity ($v_{robot}$) in a straight direction with respect to a travel path PATH. The control system 70 may utilize the one or more position sensors previously described as feedback so that the controller 72 is able to use closed-loop speed control to maintain the constant velocity of the vehicle 12 to adjust for varying terrain encountered by the vehicle 12. For example, a velocity control loop may be implemented by the control system 70 with a preset velocity and the error between the preset velocity and the measured velocity being used to adjust power output to the drive motors 24*a*, 24*b*, e.g., using a PID control loop. Separate control loops may be used for each drive motor 24*a*, 24*b* and associated sets of wheels 18*a*, 18*b*. In some versions, the feedback may be provided by sensors S that measure rotation of the wheels 18*a*, 18*b* so that the rotations of the wheels 18*a*, 18*b* are controlled to maintain a travel direction/speed of the vehicle 12 along the travel path PATH. In some versions, a global positioning system (GPS) could be used to determine a current location, velocity, etc. of the vehicle 12 for purposes of controlling the vehicle 12 to keep along the travel path PATH at the constant velocity ($v_{robot}$).

Still referring to FIG. 6, the identification module M1 is run repeatedly to identify any potential trash T in the field of view FOV of the camera 38. For example, the identification module M1 may repeat execution of its programming every 1.0 second, 0.1 seconds, 0.01 seconds, or at any other suitable frame rate. At the first time ($t_1$), the trash T is within the field of view FOV of the camera 38 and the controller 72 is able to identify the trash T within the field of view FOV by processing one or more images captured by the camera 38 during execution of the identification module M1. When the trash T is initially identified in the one or more images, then the controller 72 may effectively ignore that same trash T in subsequent images. In some versions, the same trash T is continuously identified in the images so long as the trash T remains in the field of view FOV of the camera 38.

The controller 72 locates the trash T within a camera coordinate system CCS of the camera 38, which may be a two-dimensional or three-dimensional coordinate system, by assigning the trash T coordinates in the camera coordinate system CCS. In the version shown in FIG. 6, the camera coordinate system CCS is a two-dimensional coordinate system defined in a plane parallel to the ground G and the trash T may be identified by a pair of coordinates ($x_{image}$, $y_{image}$) to indicate a location of the trash T in the camera coordinate system CCS. The camera coordinate system CCS may be fixed relative to the frame 14. It should be appreciated that the control methods described herein are in reference to the camera coordinate system CCS, but any other suitable coordinate system may be used.

Any suitable form of image processing algorithms may be used to identify the trash T in the images. In some versions, the images captured by the camera 38 are processed using dynamic background subtraction along with basic color detection to locate the trash T within the images. Techniques such as R-CNN, Fast R-CNN, and Faster-RCNN techniques, Scale-Invariant Feature Transforms (SIFT), Speeded Up Robust Features (SURF), You Only Look Once (YOLO), and/or other techniques may be employed for object localization and/or recognition. The identification module M1 first receives the images from the camera 38 as input into the identification module M1. The identification module M1 then processes the images using one or more of the techniques referenced above, and outputs bounding boxes defined by a point (coordinates), width, and/or height around the trash T in the camera coordinate system CCS. The identification module M1 may additionally classify the trash T found in the images (e.g., with one or more integers that are mapped to class labels).

Once the trash T has been identified and located via the pair of coordinates ($x_{image}$, $y_{image}$), the controller 72 is configured to coordinate operation of the drive 16, the trash collection unit 40, and the actuator 58 based on the location of the trash T to move the vehicle 12 along the ground G and adjust the position of the vacuum head 48 so that the vacuum head 48 is positioned adjacent to the trash T to collect the trash when the vacuum pump/motor 42 is activated. More specifically, the behavior module M2 translates the coordinates ($x_{image}$, $y_{image}$) of the trash T into a series of commands for the drive motors 24*a*, 24*b*, vacuum pump/motor 42, and rail motor 66 to move the vacuum head 48 over the trash T and collect it. This may include the controller 72 computing, based on the location of the trash T, values of one or more operational parameters for the drive motors 24*a*, 24*b*, vacuum pump/motor 42, and/or rail motor 66. Such operational parameters may include one or more of position, velocity, acceleration, current, voltage, and torque.

Still referring to FIG. 6, when the location of the trash T is determined at the first time ($t_1$), the controller 72 also stores a current location ($x_1$, $y_1$) of the vacuum head 48 to determine head-to-trash relationships ($\Delta x$, $\Delta y$) in the camera coordinate system CCS (or other common coordinate system) between the vacuum head 48 and the trash T at that time. The current location ($x_1$, $y_1$) of the vacuum head 48 can be determined by monitoring a position of the vacuum head 48. The rail motor 66 may have a position sensor, as previously mentioned, such as a hall-effect sensor or encoder to count rotations of the drive screw 62 and infer the location of the carriage 60 and vacuum head 48 by counting rotations of the drive screw 62. Absolute encoders, or any other suitable form of sensors may be used to determine the current position of the vacuum head 48. The rail motor 66 may be a stepper motor in which steps can be counted to infer the location of the carriage 60 and the vacuum head 48.

Incremental sensing methods can be combined with a calibration procedure to provide absolute coordinates of the vacuum head 48 in the camera coordinate system CCS. The calibration procedure may include the carriage 60 and vacuum head 48 being adjusted to extreme ends of the drive screw 62 until the limit switches LS, which are placed at the ends on the supports 34 (see FIG. 1), are engaged by the carriage 60. The controller 72 can then count the full number of turns/rotations of the drive screw 62 or steps of the stepper motor between the ends and then, knowing the distance between the ends (e.g., the coordinates of the ends), can calculate an associated change in distance with each turn/step and thereafter can control the number of turns/steps to control movement. The controller 72 can monitor/store the traveled distance in the x-axis direction and the associated x-axis coordinate $x_1$. The y-axis coordinate $y_1$ is a known, constant coordinate that can be measured after manufacture of the robotic system 10, since the vacuum head 48 only moves in the x-direction in some versions, such as the version shown.

Once the current location ($x_1$, $y_1$) of the vacuum head 48 is determined, then target coordinates ($x_{target}$, $y_{target}$) for the vacuum head 48 can be determined in the camera coordinate system CCS. The target coordinates ($x_{target}$, $y_{target}$) are based on the relationships: (i) $x_{target}=x_{image}$; and (ii) $y_{target}=y_1$. The head-to-trash relationships ($\Delta x$, $\Delta y$) between the current location of the vacuum head 48 and the trash T can then be determined by the calculations $\Delta x=x_1-x_{target}$ and $\Delta y=y_{target}-y_{image}$. Once these relationships are established, then the time to activate the vacuum pump/motor 42 ($t_{suction}$) and a velocity ($v_{head}$) of the vacuum head 48 needed to reach the target coordinates in time ($t_{suction}$) to collect the trash T is calculated by the calculations: (i) $t_{suction}=(\Delta y/v_{robot})+t_1$; and (ii) $v_{head}=\Delta x/(t_{suction}-t_1)$. These relationships and calculations are also shown in FIG. 7. It should be appreciated that other methods and calculations can be used to position the vacuum head 48 relative to trash T to collect the trash T.

Once the velocity ($v_{head}$) and time ($t_{suction}$) are calculated, then these values can be input into the control module M3 and the controller 72 can then command the rail motor 66 to operate at the commanded velocity until the time ($t_{suction}$) is reached and the vacuum pump/motor 42 can also be commanded to operate at that time ($t_{suction}$). In some versions, the velocity ($v_{head}$) required for moving the vacuum head 48 may simply be a check to confirm that the vacuum head 48 can be moved quickly enough to align the vacuum head 48 with the trash T in order to collect the trash T, but the rail motor 66 may actually be operated at a faster speed such that the position of the vacuum head 48 is changed until it reaches the target position ($x_{target}$, $y_{target}$), but before the time ($t_{suction}$). In some cases, if the calculated velocity ($v_{head}$) to move the vacuum head 48 to reach the trash T exceeds a maximum velocity of the vacuum head 48 ($v_{max}$), the controller 72 can reduce the velocity of the vehicle 12

($v_{robot}$) as needed. For example, when two pieces of trash T are at/near the same y coordinate, but substantially separated from one another in the x-direction, the rail motor 66 may not be able to move quickly enough to align the vacuum head 48 with both pieces of trash T at the current velocity of the vehicle 12. In this case, the controller 72 may calculate $t_{suction}$ first using $v_{max}$, compute $v_{robot}$, and then control the drive motors 24*a*, 24*b* accordingly. In some versions, movement of the vacuum head 48 can be constant and the velocity of the vehicle 12 ($v_{robot}$) varied. The vehicle 12 may also be stopped by the controller 72 as needed to provide enough time for the vacuum head 48 to reach the trash T. In some versions, when multiple pieces of trash T are identified in the images, the controller 72 selects the trash T that has the y-coordinate with the largest value (i.e., closest to the axis A2) to process first, and then proceeds in succession with the next closest, etc. In other words, the controller 72 processes the trash T in an order to collect all trash that is identified in the images while still moving the vehicle 12, if possible.

Figure 8:
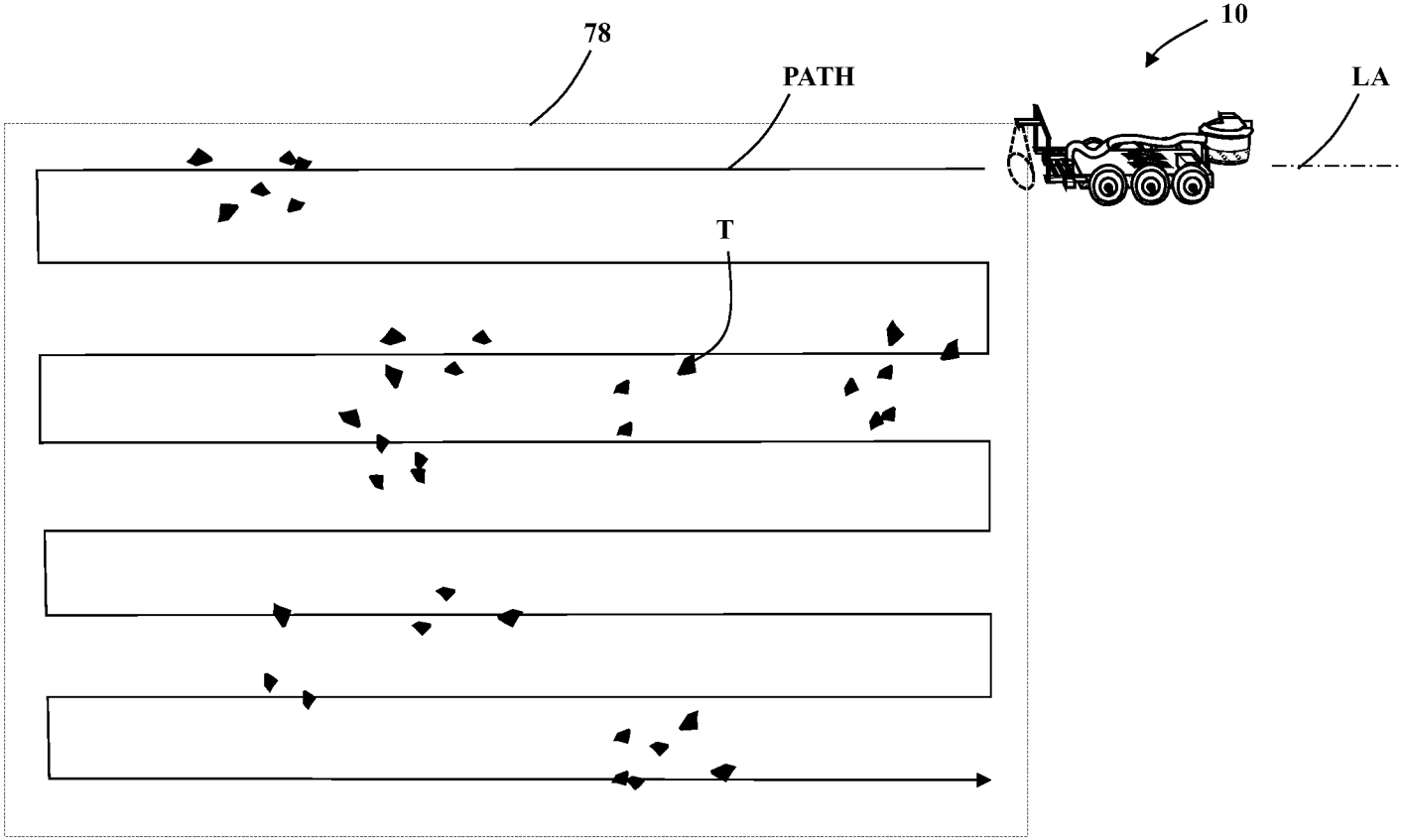
FIG. 8 is an illustration of an area covered by the robotic system when collecting trash.

Referring to FIG. 8, during operation, the control system 70 operates the robotic system 10 to process an area 78 for trash T removal by generally following along the travel path PATH. The travel path PATH may be predefined, defined during operation, made up of random segments and/or predefined segments, combinations thereof, and the like. The control system 70 may initially operate the drive 16 so that the vehicle 12 moves at a constant velocity to keep a longitudinal axis LA of the vehicle 12 aligned with the travel path PATH, or the velocity of the vehicle 12 can be varied, as previously described. After a predetermined amount of distance or time has passed, or when the GPS indicates (if used), the control system 70 is configured to turn the vehicle 12 to stay on the travel path PATH, such as by turning 180 degrees.

The controller 72 is configured to operate the drive 16 to move the vehicle 12 autonomously along the ground G while collecting the trash T and to cover the predefined area 78 for trash T removal. A user may initiate and/or cease such autonomous movement via the user interface UI, or it may be initiated/stopped at preset times each day, or according to a predefined schedule. In some versions, instead of being a fully autonomous vehicle 12, the user interface UI may include remote control operation of the vehicle 12, including remote control of the speed and steering of the vehicle 12.

Figure 9:
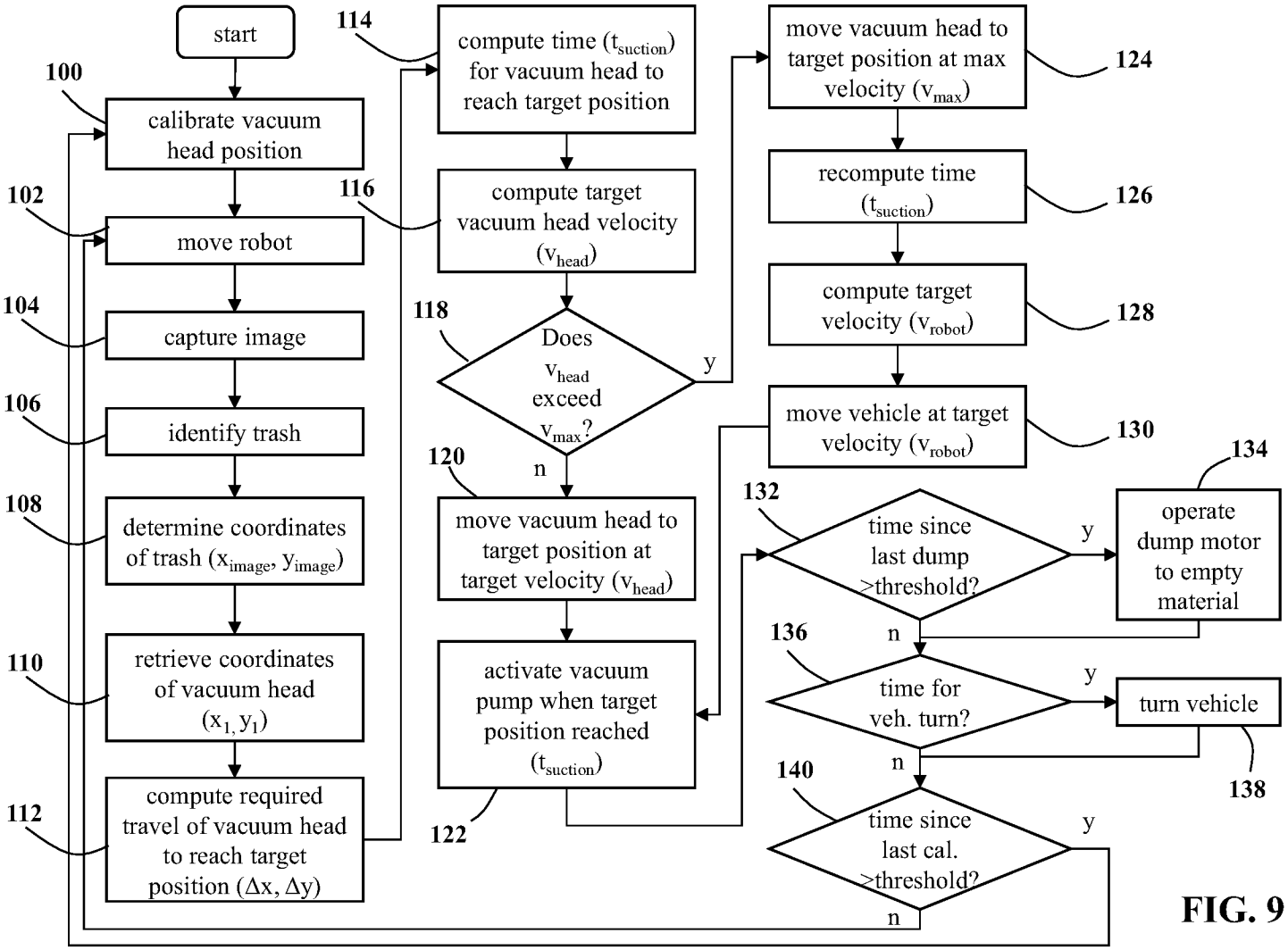
FIG. 9 is a flowchart of example steps carried out to collect the trash.

Referring to FIG. 9, example steps are shown for carrying out operation of the robotic system 10 to collect the trash T. In step 100, the position of the vacuum head 48 is calibrated utilizing the calibration procedure noted above so that a position of the vacuum head in the camera coordinate system CCS can be determined. In some versions, after calibration, the vacuum head 48 is set to a predetermined starting position in the camera coordinate system CCS.

In step 102, the vehicle 12 is moved along the ground G, e.g., autonomously, via remote control, etc. and may be moved initially at a constant speed. In step 104, one or more images of the trash T are captured while the vehicle 12 moves along the ground G. The trash T is then identified and the coordinates ($x_{image}$, $y_{image}$) of the trash T in the camera coordinate system are determined in steps 106 and 108 using one or more of the object localization and recognition algorithms previously mentioned. The current coordinates ($x_1$, $y_1$) of the vacuum head 48 are retrieved from memory in step 110. The controller 72 computes required travel ($\Delta x$, $\Delta y$) of the vacuum head 48 in step 112 to reach the target position ($x_{taget}$, $y_{target}$). The time ($t_{suction}$) to activate the vacuum pump/motor 42 is calculated in step 114 and the velocity ($v_{head}$) of the vacuum head 48 needed to reach the target coordinates in time ($t_{suction}$) to collect the trash T is calculated in step 116.

In step 118, the controller 72 determines if the calculated velocity ($v_{head}$) exceeds a maximum velocity of the vacuum head 48 ($v_{max}$). If not, then the controller 72 commands the rail motor 66 to operate at the target velocity ($v_{head}$) until the time ($t_{suction}$) is reached. This results in the rail motor 66 moving the vacuum head 48 to the target position ($x_{target}$, $y_{taget}$) at the target velocity ($v_{head}$) in step 120. The vacuum pump/motor 42 is commanded in step 122 to activate at the time ($t_{suction}$) when the target position ($x_{taget}$, $y_{target}$) is reached. If the controller 72 determines that the calculated velocity ($v_{head}$) does exceed the maximum velocity ($v_{max}$) of the vacuum head 48, the controller 72 may move the vacuum head 48 at the maximum velocity ($v_{max}$) in step 124 and then, in step 126, recompute the time ($t_{suction}$) using $v_{max}$. In step 128, the controller 72 can then compute a new target robot velocity ($v_{robot}$) and control the drive motors 24*a*, 24*b* accordingly to move the vehicle 12 at the new target velocity ($v_{robot}$) in step 130. The method then continues back to step 122 to activate the vacuum pump/motor 42. In some versions, the vacuum pump/motor 42 can be activated/operational a predetermined amount of time (e.g., 1, 2, 3 seconds or more) before and/or after the time is reached to ensure trash collection. When not active/operational, the vacuum pump/motor 42 may be turned off to avoid additional sand, dirt, or other material from being collected from the ground G.

In some versions, during each frame of operation of the identification module M1 and the behavior module M2, a single piece of trash T is identified and computations made to determine the required travel of the vacuum head 48 and/or vehicle 12 to reach the target position ($x_{target}$, $y_{target}$) and the time ($t_{suction}$) to activate the vacuum pump/motor 42 before processing a subsequent piece of trash T present in the same image. In some versions, in one frame of operation of the identification module M1, target positions are determined for all of the pieces of trash T captured in the one or more images taken at the first time ($t_1$). The behavior module M2 then determines the appropriate sequence of movements of the vacuum head 48 and/or the vehicle 12 to reach all of the pieces of trash T, and the appropriate sequence of times ($t_{suction}$) to activate the vacuum pump/motor 42, which are then executed in the manner described herein. In some versions, the machine vision unit 32 may operate in a batch manner to capture images periodically based on the movement of the vehicle 12, e.g., to avoid significant overlap in the one or more images that are captured. In other words, once one or more images are captured of an area on the ground G, then the machine vision unit 32 waits until the vehicle 12 traverses a distance substantially equal to a dimension of the field of view FOV and then activates the machine vision unit 32 to capture another set of one or more images to determine the trash T to be collected. In some versions, images are constantly being captured at a predetermined capture rate.

In step 132, the controller 72 evaluates the last time that the trash canister 46 was dumped, i.e., the last time the movable bottom 54 was opened. If the elapsed time is greater than a predefined threshold time, the controller 72 operates the dump motor 56 in step 134 to empty the contents of the trash canister 46 that have passed through the screens 50, 52. In some versions, the controller 72 is configured to operate the dump motor 56 if a weight/pressure sensor detects a load over a predefined threshold load.

In step 136, the controller 72 determines if the vehicle 12 has completed traversing a leg of the travel path PATH and requires turning. If so, in step 138, the controller 72 operates the drive motors 24*a*, 24*b* as needed to turn the vehicle 12. In some versions, the vehicle 12 may have a steering system to enable such maneuvers, in which case the steering system would be controlled in step 138 to make the turn.

In step 140, the controller 72 determines how much time has elapsed since the last time that the controller 72 performed calibration of the actuator 58. If the elapsed time is greater than a predetermined threshold time, then the method continues with a new calibration at step 100, otherwise the method continues moving the vehicle 12 at step 102.

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A robotic system for collecting trash along a beach, the robotic system comprising:

a vehicle including a frame and a drive;

a camera coupled to the vehicle to move with the vehicle to capture images of the trash while the vehicle moves along the beach, wherein the camera has a camera coordinate system fixed relative to the frame;

a trash collection unit carried by the vehicle to collect the trash, the trash collection unit including a vacuum pump and a collection conduit having a vacuum head for positioning adjacent to the trash to collect the trash, wherein the trash collection unit further includes a trash canister having a plurality of material separation screens to retain the trash in the trash canister, a movable bottom to release sand that is sized to pass through the plurality of material separation screens, and a dump motor operatively coupled to the movable bottom to selectively open and close the trash canister;

an actuator operatively coupled to the collection conduit to adjust a position of the collection conduit relative to the vehicle to position the vacuum head of the collection conduit adjacent to the trash to collect the trash, wherein the actuator includes a carriage, a drive screw, a stepper motor, and limit switches; and a controller coupled to the drive, the camera, the trash collection unit, the dump motor, and the actuator to coordinate movement of the vehicle, positioning of the collection conduit relative to the vehicle based on the images of the trash captured by the camera, operation of the dump motor to periodically release the sand from the trash canister, and operation of the vacuum pump to collect the trash;

wherein the controller is configured to:

calibrate the actuator by adjusting the carriage to each end of the drive screw until the limit switches are engaged by the carriage to determine a current location of the vacuum head in the camera coordinate system;

operate the drive of the vehicle so that the vehicle moves at a vehicle velocity along a predefined path on the beach;

identify the trash in the images of the trash captured by the camera and assign coordinates to the trash in the camera coordinate system as the vehicle moves along the predefined path;

determine target coordinates for the vacuum head in the camera coordinate system based on a relationship between the coordinates assigned to the trash and the current location of the vacuum head;

calculate, based on the vehicle velocity, a commanded time to activate the vacuum pump and a commanded velocity of the vacuum head needed to reach the target coordinates in time to collect the trash;

determine if the commanded velocity exceeds a maximum velocity of the vacuum head and if the commanded velocity does not exceed the maximum velocity, adjust the position of the vacuum head relative to the vehicle at the commanded velocity while the vehicle is moving along the predefined path, so that the vacuum head is positioned at the target coordinates adjacent to the trash to collect the trash at the commanded time;

activate the vacuum pump at the commanded time when the vacuum head reaches the trash to collect the trash;

deactivate the vacuum pump a predetermined amount of time after activating the vacuum pump to ensure that the trash is collected;

evaluate an elapsed time since the dump motor was operated to release the sand; and determine if the elapsed time is greater than a predefined threshold time and if the elapsed time is greater than the predefined threshold time, operate the dump motor to release the sand.

2. The robotic system of claim 1, wherein the vehicle includes a first plurality of wheels rotatably coupled to the frame and a second plurality of wheels rotatably coupled to the frame, the drive including a first drive motor operatively coupled to the first plurality of wheels to rotate the first plurality of wheels and a second drive motor operatively coupled to the second plurality of wheels to rotate the second plurality of wheels independently of the first plurality of wheels.

3. The robotic system of claim 2, wherein the first plurality of wheels includes at least three wheels located at a first side of the vehicle and the second plurality of wheels includes at least three wheels located at a second side of the vehicle.

4. The robotic system of claim 3, wherein each of the wheels includes a balloon tire.

5. The robotic system of claim 1, comprising reflective material attached to the vehicle.

6. The robotic system of claim 5, comprising reflective material attached to the trash collection unit.

7. The robotic system of claim 6, wherein the reflective material includes one or more of reflective tape, reflective coating, or reflective paint.

8. The robotic system of claim 1, wherein the controller is configured to operate the drive to move the vehicle autonomously along the ground while collecting the trash, the controller configured to move the vehicle to cover a predefined area for trash removal.

* * * * *